US006202842B1

(12) United States Patent
Pirro et al.

(10) Patent No.: US 6,202,842 B1
(45) Date of Patent: Mar. 20, 2001

(54) PRODUCT PACKAGING AND METHOD OF PACKING A PRODUCT

(75) Inventors: Jeffrey P. Pirro, Marcellus; David A. Furth, Skaneateles, both of NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/385,616

(22) Filed: Jun. 30, 1999

(51) Int. Cl.[7] ..... A45C 11/26
(52) U.S. Cl. ..... 206/349; 206/464; 53/410
(58) Field of Search ..... 206/349, 461, 206/464, 465, 482, 487, 495; 53/410, 413

(56) References Cited

U.S. PATENT DOCUMENTS

| | | | | |
|---|---|---|---|---|
| 3,519,128 | | 7/1970 | Swanberg | 206/80 |
| 3,756,387 | | 9/1973 | Chaney | 206/3 |
| 3,945,494 | | 3/1976 | Weber et al. | 206/389 |
| 4,101,042 | | 7/1978 | Strong et al. | 215/11 |
| 4,354,598 | * | 10/1982 | Schillinger | 206/462 |
| 4,375,850 | | 3/1983 | Smyth et al. | 206/387 |
| 4,456,124 | | 6/1984 | Kay et al. | 206/463 |
| 4,549,654 | * | 10/1985 | Tiesman | 206/486 |
| 4,848,541 | | 7/1989 | Paliotta et al. | 206/45.14 |
| 4,899,882 | | 2/1990 | Benner | 206/470 |
| 5,392,919 | * | 2/1995 | Passamoni | 206/576 |
| 5,509,532 | | 4/1996 | Brody | 206/349 |
| 5,649,621 | | 7/1997 | Brody | 206/349 |
| 5,672,238 | | 9/1997 | Samuelson | 156/579 |
| 5,813,532 | | 9/1998 | Kheradpir et al. | 206/379 |

* cited by examiner

*Primary Examiner*—David T. Fidei
(74) *Attorney, Agent, or Firm*—Robert W. Welsh

(57) ABSTRACT

A display card retains a flashlight thereon, wherein the flashlight has a body comprising two body halves, each body half defining a portion of an interior cavity and are matingly abutted one to the other. The mated halves further define at least two slots therein. The display card comprises a semi-rigid card defining a cutout that receives at least a portion of the flashlight. At least two tabs extend into the cutout, and each of the tabs is received in a different one of the slots. The tabs extend into the interior cavity of the flashlight in a manner to suspendingly retain the flashlight in the cutout for display.

15 Claims, 4 Drawing Sheets

PRODUCT PACKAGING AND METHOD OF PACKING A PRODUCT

BACKGROUND OF THE INVENTION

The present invention relates to cards for displaying items for sale, and more particularly to a combined display card and flashlight.

The common practice for displaying small and lightweight retail items, such as handheld flashlights, is to package the items in a blister pack and place them on shelves or hang them in various displays. Blister packs generally comprise two pieces of clear plastic that are attached to each other thereby defining a cavity retaining the item to be displayed. Small items packaged in such a manner are less prone to shoplifting as a result of the physical size of the blister pack. The blister pack also isolates the product from the purchaser, preventing inadvertent damage that can result from repeated handling prior to sale. Such damage may not be readily visible to the purchaser, such as leaving a disposable electrical product turned on, thereby draining the batteries and rendering the product useless. The blister pack also permits irregularly shaped products to be displayed in an orderly fashion, such as by including an aperture at the top of the blister package and hanging the individual product packages from hooks and the like in the store.

While the blister pack has significant advantages as discussed above, it also possesses some inherent disadvantages. To decrease the probability of shoplifting small and relatively expensive items, such as cameras, electronic components, or the like, the blister pack must be relatively large in comparison. Consequently, the cost of fabricating and assembling the blister pack can become quite expensive and add significant cost to the product. While the blister pack prevents direct handling of the product to minimize pre-sale damage, the isolation of the product inside the blister pack also prevents tactile feedback to a potential user that can only be obtained by directly handling the product. Such tactile feedback, wherein a prospective user or customer can tactilely experience unique features of the product, can also enhance sales of the item as compared to the same product displayed in a blister pack.

Thus, there is a need, heretofore unfulfilled, for a relatively inexpensive display card for disposable electronic products, that securely holds the product and functions to prevent power switches from remaining in the on position to maintain as much electrical power as is possible.

SUMMARY OF THE INVENTION

One aspect of the present invention is a display card retaining a flashlight thereon. The flashlight has a body comprising two body halves. Each body half defines a portion of an interior cavity, and the halves are matingly abutted one to the other. The mated halves further define a slot therein. The display card comprises a semi-rigid card defining a cutout therein. The card receives at least a portion of the flashlight in the cutout, and a tab extends into the cutout and is received the slot. The tab further extends into the interior cavity of the flashlight in a manner that suspendingly retains the flashlight for display.

Another aspect of the invention is a display card retaining a flashlight thereon wherein the flashlight has a body comprising two body halves. The flashlight includes a switch mounted on the body and translates between an off position and an on position. Each body half defines a portion of an interior cavity and matingly abut one to the other. The mated halves further define at least two slots therein. A first of the slots is proximate to the switch, wherein the display card comprises a semi-rigid card defining a cutout therein, and receives at least a portion of the flashlight in the cutout. At least two tabs extend into the cutout, wherein each of the tabs are received in a different one of said slots, said tabs further extending into the interior cavity of the flashlight in a manner to suspendingly retain the flashlight for display.

Yet another aspect of the current invention is a method of mounting a display card to a flashlight for display. The method comprises the steps of providing a partially disassembled flashlight wherein at least a body of the flashlight is separated into two halves, each body half defining at least a portion of each of a plurality of slots. A card is provided that defines a cutout. The cutout is formed to receive at least a portion of the flashlight body. A plurality of tabs extend from the card into the cutout and are positioned to correspond to the slots in the flashlight body. The card is placed on one of the body halves. The tabs are aligned with the partially defined slots, and the second of the body halves is mated to the first, thereby trapping the card tabs within the flashlight body.

These and other features, advantages and objects of the present invention will be further understood and appreciated by those skilled in the art by reference to the following specification, claims and appended drawings.

DETAILED DESCRIPTION OF PREFERRED EMBODIMENT

Figure 2:
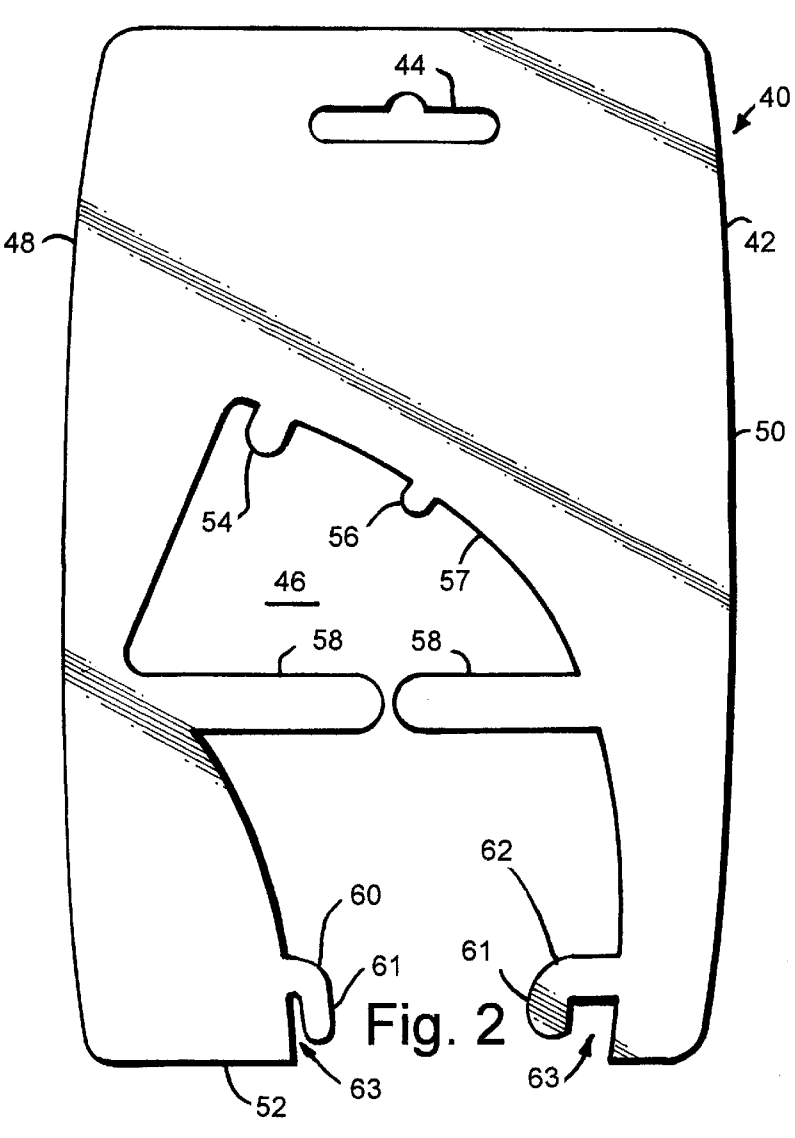
FIG. 2 is a front elevation view of a second embodiment of the display card.
Figure 1:
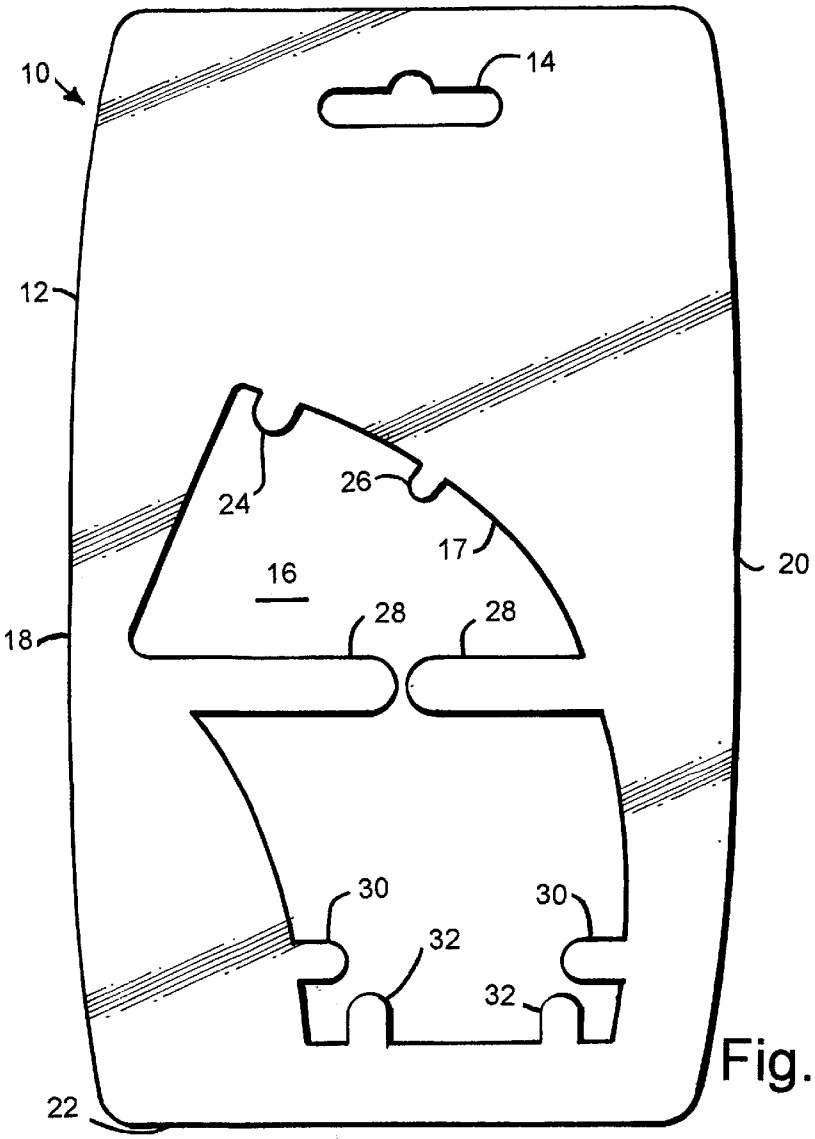
FIG. 1 is a front elevation view of a display card embodying the present invention.

For purposes of description herein, the terms "upper", "lower", "right", "left", "rear", "front", "vertical", "horizontal", and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1, and 3–5 show a display card 10 and a display card and flashlight combination 64, which is one of the preferred embodiments of the present invention, and illustrates its various components. Display card 10 as disclosed herein is intended to provide an inexpensive and easily manufactured display card that permits the handling of the product for consumer familiarity, and does not require the disassembly of the product to remove the display card.

Figure 3:
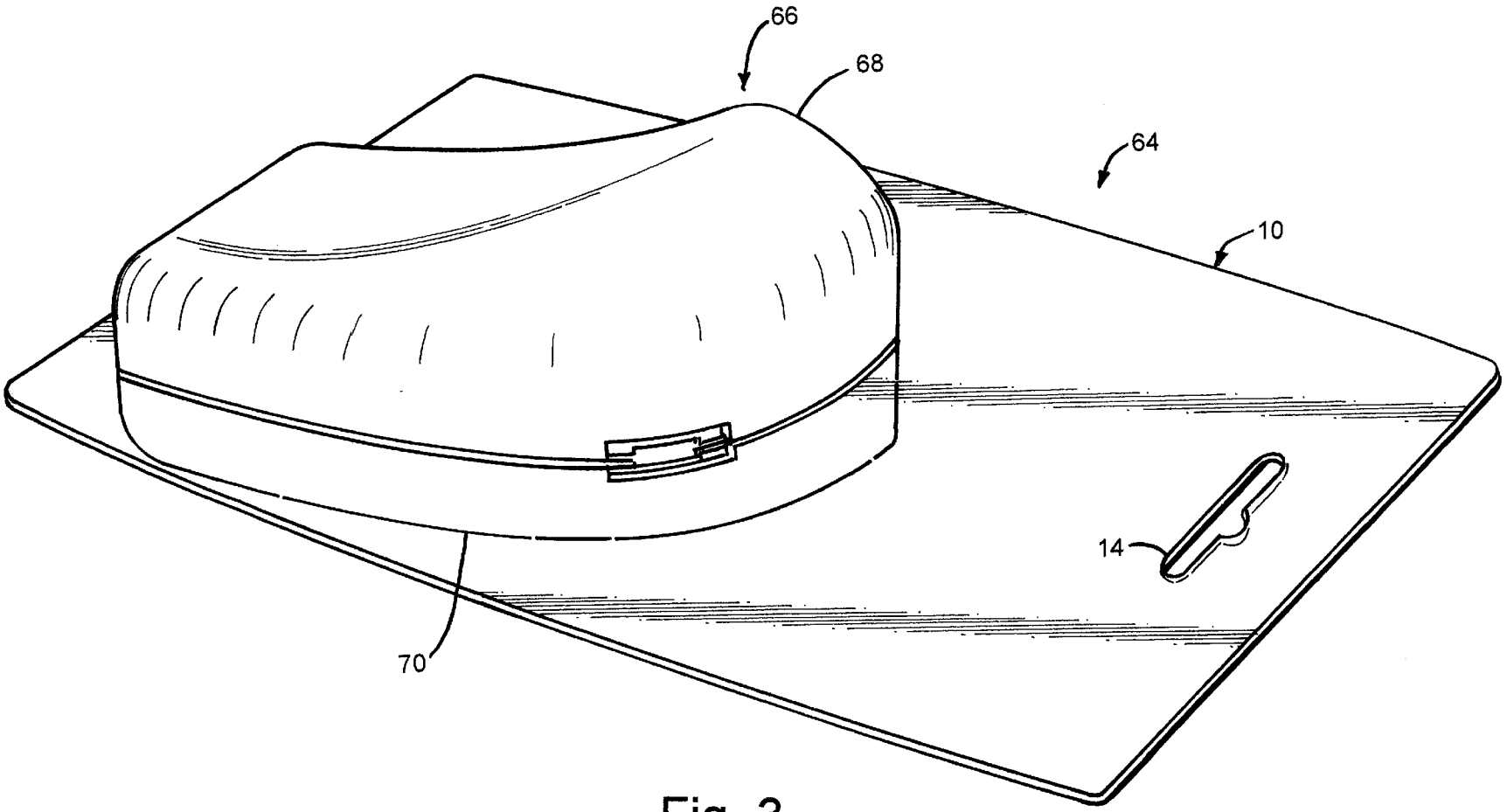
FIG. 3 is perspective view of a flashlight body assembled around the display card of FIG. 2 and rotated 90 degrees.

Display card 10, most easily seen in FIG. 1, is fabricated from a planar card 12 of a relatively thin semi-rigid material, such as plastic or paperboard. The card material has enough thickness to provide sufficient shear strength to support a product to be displayed thereon, yet retains some flexibility so that the display card can be flexed. Display card 10 has an aperture 14 at an upper end thereof to facilitate the hanging of the display card and a supported product in a retail sales display. Display card 10 also defines a product cutout 16 having a perimeter 17 slightly larger than the shape and size of the product to be displayed. Cutout 17 in the present embodiment corresponds substantially to the size and shape of flashlight body 66 as shown in FIG. 3. However, it will be understood that cutout 16 can be revised to conform to any size and shape of product.

Cutout 16 in the preferred embodiment is totally surrounded by portions of card 12 such that display card 10 is further comprised of left side 18, right side 20, and bottom 22. Bottom 22 has one or more bottom tabs 32 extending into cutout 16. Bottom tabs 32 are relatively short, and in the preferred embodiment are approximately three-eighths of an inch in length. However, the length can be modified as necessary, depending on the requirements of a particular product card combination. Additional tabs such as bottom side tabs 30, lateral tabs 28, and upper tab 24 also extend into cutout 16 from periphery 17 to provide a distribution of tabs around periphery 17 for the support of the product in a manner described below. Lateral tabs 28 are significantly greater in length than tabs 24, 26, 30, and 32, and in the preferred embodiment are of sufficient length to meet approximately in the middle of cutout 16.

Figure 4:
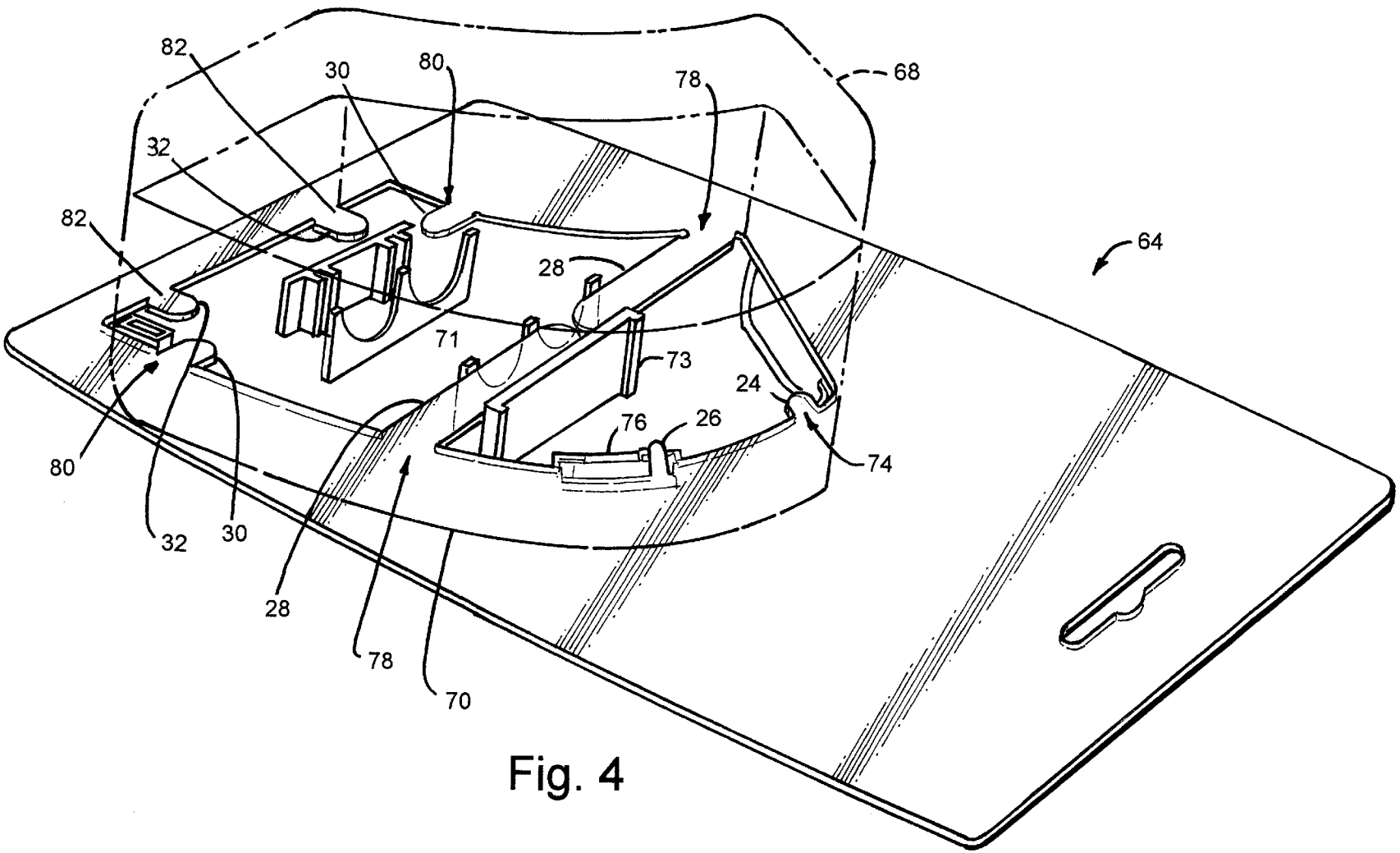
FIG. 4 is the perspective view of FIG. 3 with the front half of the flashlight body shown in phantom and exploded away from the display card.

Turning now to FIGS. 3 and 4, a flashlight body 66 comprising font and rear body halves 68 and 70 are shown assembled to capture display card 12 between body halves 68 and 70 to produce a display card and flashlight combination 64. As shown in FIG. 4 with body half 68 shown in phantom and exploded away from combination 64, the retention of card 12 by flashlight body 66 is readily apparent. Body halves 68 and 70 further define an interior cavity 71. Body half 70 has a peripheral lip 72 extending about its periphery, and body half 68 has a mating lip (not shown) to facilitate the engagement of body halves 68 and 70 one with the other. In the present embodiment, flashlight 64 is a disposable flashlight, and therefore halves 68 and 70 are permanently joined with each other after the inclusion therein of batteries, a reflector, a light bulb, and a lens (all of which have been removed for clarity).

Flashlight halves 68 and 70 have periodic interruptions in peripheral lips 72. The interruptions in each of the peripheral lips define portions of upper slot 74, switch slot 76, lateral slots 78, lower side slots 80, and bottom slots 82. These slots are positioned and sized to receive tabs 24, 26, 28, 30, and 32 extending into flashlight interior cavity 71, respectively. Body half 70 also includes a shelf 73 that can bear upon the upper edges of lateral tabs 28 for additional vertical support of the flashlight when combination 64 is hung in a vertical orientation.

Figure 5:
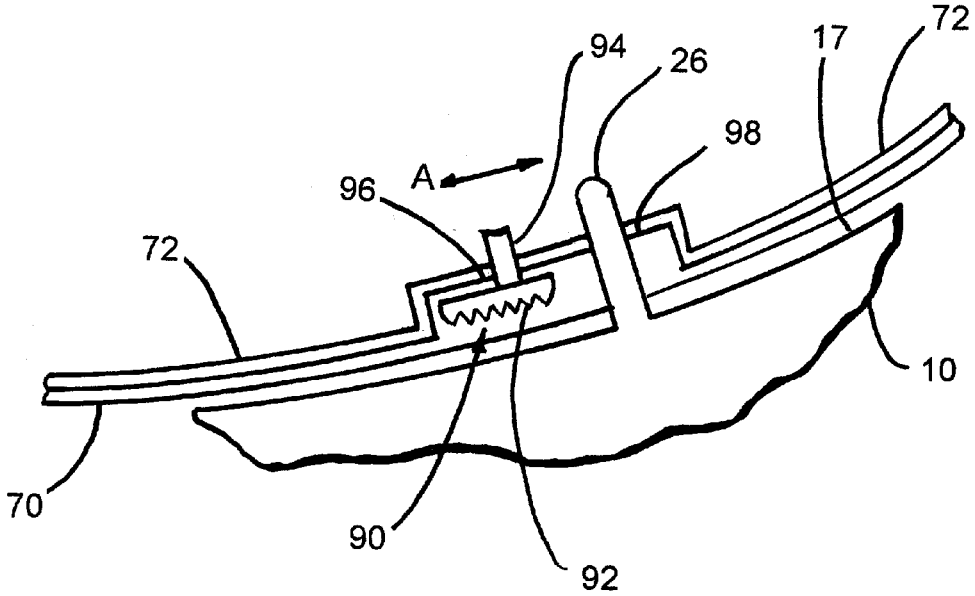
FIG. 5 is an enlarged view of a flashlight switch in relation to a display card tab wherein the tab permits partial translation of an on-off switch.
Figure 6:
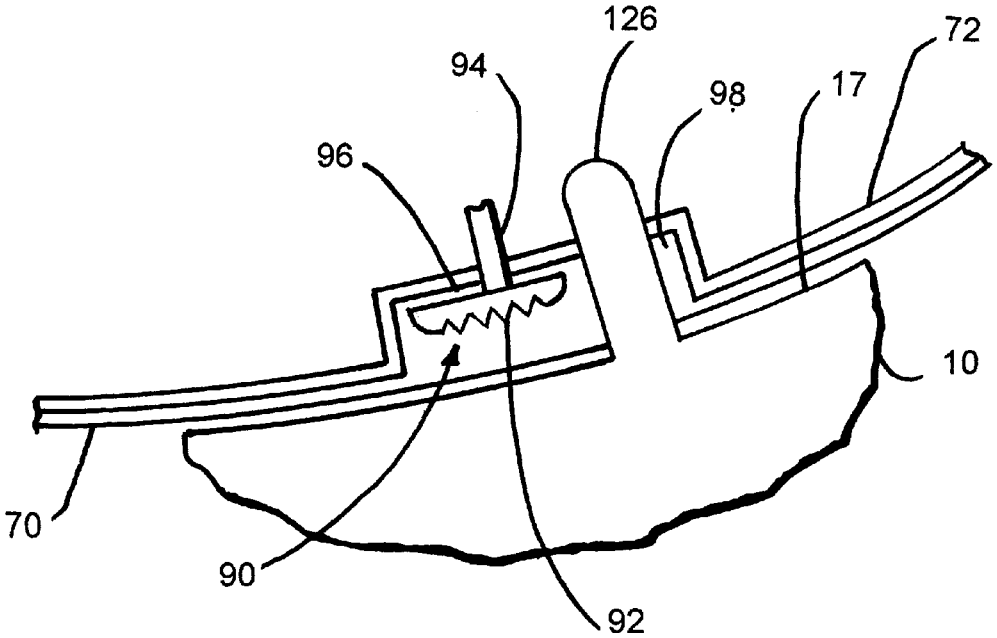
FIG. 6 is an enlarged view of a flashlight switch wherein a display card tab prevents any translation of the switch.

FIGS. 5 and 6 show an enlarged view of the flashlight switch area, including tab 26 of card 10, extending into switch slot 76 of flashlight 66, and the relation of tab 26 to the functioning of switch actuator 90. Flashlight 66 includes a finger operated switch actuator 90 that is translatable between an off position and an on position. Switch actuator 90 includes a finger grip 92 that is positioned for convenient operation by the finger or thumb of a user, and an actuator post 94 extending into interior 17 of flashlight body 66. Post 94 connects to an electrical switch in flashlight body 66 for selectively applying electrical power to the light bulb. Switch actuator 90 is normally biased to the off position until it passes a detent to retain it in the on position. The translation of switch actuator 90 is limited by switch post 94 contacting off position stop 96 and on position stop 98. This is accomplished in a manner common to the flashlight art, and therefore requires no further explanation. An intermediate position of switch actuator 90, when translated partially toward the on position, will apply electrical power to the bulb, thereby illuminating the bulb until the user's finger is removed from finger grip 92 wherein the bias of the switch assembly returns switch actuator 90 to the off position.

As further shown in FIG. 5, tab 26 extends through switch slot 76 and partially blocks the switch actuator from its translation travel between its off position and its on position. In the preferred embodiment, tab 26 permits partial translation as indicated by arrow "A". Tab 26 thereby permits the flashlight to be tested by permitting the switch actuator to apply electrical power to the bulb, but blocking the switch actuator from engaging the detent to retain actuator 90 in the on position. An alternate embodiment of tab 26 is shown in FIG. 6, wherein tab 126 is wider than tab 26 as described above. In this embodiment, tab 126 prevents all translation of switch actuator 90, and therefore prevents any electrical power from being applied to the bulb. Engagement of the on detent in either embodiment can occur only when display card 10 has been removed from flashlight 66.

Slots 74–82 are slightly larger than corresponding tabs 24–32 such that by applying a force to display card 12 and substantially lateral to its plane, tabs 24–32 are readily and easily removable from the slots to permit easy consumer removal of display card 12 for use of the flashlight.

FIG. 2 discloses another embodiment 40 of the display card. Display card 40 comprises a card 42 of the same material as card 12 above, and includes an aperture 44 for hanging on a display. Display card 40 defines a cutout 46 at a lower portion thereof, that substantially corresponds to the profile of the product to be received therein. In this embodiment, cutout 46 extends to the bottom of card 40, thus permitting a portion of the product to extend below the bottom edge 52. Display card 40 includes tabs similar to those of display card 10. However, lower side tabs 60 and 62 also include a downward projecting portion 61 which in combination with sides 48 and 50, define slots 63. Slots 63 engage an interior portion of body halves 68 and 70 in a manner to make removal of tabs 60 and 62 from slots 80 of flashlight body 66 more difficult. The increased difficulty of removal of tabs 60 and 62 is necessitated by the absence of a bottom to display card 40 tying the bottom portions of sides 48 and 50 in a fixed lateral relationship.

In use, body half 68 receives the internal components of the flashlight, such as batteries, wiring, switches, reflectors, and bulbs. Display card 12 is placed on body half 68 in a manner that tabs 24–32 are received in slots 74–82. Body half 70 is affixed to body half 68 and the flashlight and display card combination 64 is then ready for retail display. After purchase by a consumer, display card 10 is easily extracted from flashlight 66 by applying force perpendicular to the plane of display card 12 while holding flashlight 66 stationary.

The above description is considered that of the preferred embodiment only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A display card retaining a flashlight thereon, wherein said flashlight has a body comprising two body halves, each body half defining a portion of an interior cavity and matingly abutted one to the other, said mated halves further defining a slot therein, wherein said display card comprises:

a semi-rigid card defining a cutout therein and receiving at least a portion of said flashlight in said cutout; and a tab extending into said cutout, said tab received in said slot, and said tab further extending into said interior cavity of said flashlight in a manner to suspendingly retain said flashlight for display.

2. The display card according to claim 1, wherein:

said mated halves of said flashlight define at least two slots therein; and said card includes at least two tabs.

3. The display card according to claim 2, wherein:

said slots are positioned on substantially opposite sides of said flashlight; and said at least two tabs correspondingly extend from substantially opposite edges of said cutout.

4. The display card according to claim 3, wherein at least one of said tabs on each side of said cutout substantially extends to a middle of said flashlight interior.

5. The display card according to claim 4, wherein said card is an inverted U-shape, said cutout defined by an interior of said U-shape and having an open bottom, and a bottom of said flashlight extending downwardly from said open bottom.

6. The display card according to claim 5, further including:

at least a third tab extending into said cutout wherein said third tab is L-shaped and positioned at a lower edge of said card; and at least a third slot defined in said flashlight body receiving said L-shaped tab wherein said L-shaped tab engages a portion of an interior wall of said flashlight body in a manner to prevent a lateral extraction of said third tab from said third slot.

7. The display card according to claim 3, wherein said card includes a bottom and further wherein said cutout defined by said card substantially conforms to the entire perimeter of said flashlight.

8. The display card according to claim 7, further including:

at least a third tab extending into said cutout from said bottom of said card; and at least a third slot defined in a bottom of said flashlight body receiving said third tab therein.

9. The display card according to claim 3, further including:

a switch mounted in said flashlight body, said switch translatable between an off position and an on position;

at least a third slot in said flashlight body positioned proximate to said on position of said switch; and at least a third tab extending into and received by said third slot wherein said third tab blocks said switch to prevent said switch being translated from said off position to said on position.

10. The display card according to claim 9, wherein:

said switch, when not fully translated to said on position, is biased to said off position; and said third tab permits partial translation of said switch from said off position to an intermediate position permitting said flashlight to be tested while preventing said switch from being left in said on position.

11. A display card retaining a flashlight thereon, wherein said flashlight has a body comprising two body halves and including a switch mounted on said body and translatable between an off position and an on position, each body half defining a portion of an interior cavity and matingly abutted one to the other, said mated halves further defining at least two slots therein, a first of said slots proximate to said switch, wherein said display card comprises:

a semi-rigid card defining a cutout therein and receiving at least a portion of said flashlight in said cutout; and at least two tabs extending into said cutout, each of said tabs received in a different one of said slots, said tabs further extending into said interior cavity of said flashlight in a manner to suspendingly retain said flashlight for display.

12. A display card according to claim 11, wherein said tab extending into said first slot blocks prevents said switch from being translated from said off position to said on position.

13. A display card according to claim 12, wherein:

said switch, when not fully translated to said on position, is biased to said off position; and said first tab permits partial translation of said switch from said off position to an intermediate position permitting said flashlight to be tested while preventing said switch from being left in said on position.

14. A method of mounting a display card to a flashlight for display comprising the steps of:

providing a partially disassembled flashlight, wherein at least a body of the flashlight is separated into two halves, each body half defining at least a portion of each of a plurality of slots;

providing a card defining a cutout therein, the cutout formed to receive at least a portion of the flashlight body, and a plurality of tabs extending from the card into the cutout and positioned to correspond to the slots in the flashlight body;

placing the card on one of the body halves;

aligning the tabs with the partially defined slots; and mating the second of the body halves to the first, thereby trapping the card tabs within the flashlight body.

15. The method according to claim 14, wherein:

said partially disassembled flashlight providing step includes providing a flashlight with a switch translatable between an on position and an off position and providing one of the slots proximate to the switch; and said card providing step includes providing a tab for receipt by the slot proximate to the switch and sized to prevent the switch being translated to the on position.

* * * * *